US009926108B2

(12) United States Patent
Wiley et al.

(10) Patent No.: US 9,926,108 B2
(45) Date of Patent: Mar. 27, 2018

(54) SECURE UNATTENDED DELIVERY APPARATUS

(71) Applicants: Gloria Selena Wiley, San Francisco, CA (US); Paul Wiley, San Francisco, CA (US)

(72) Inventors: Gloria Selena Wiley, San Francisco, CA (US); Paul Wiley, San Francisco, CA (US)

( * ) Notice: Subject to any disclaimer, the term of this patent is extended or adjusted under 35 U.S.C. 154(b) by 945 days.

(21) Appl. No.: 13/623,738

(22) Filed: Sep. 20, 2012

(65) Prior Publication Data

US 2013/0077896 A1 Mar. 28, 2013

Related U.S. Application Data

(60) Provisional application No. 61/626,530, filed on Sep. 28, 2011.

(51) Int. Cl.

| | |
|---|---|
| ***B65D 33/00*** | (2006.01) |
| ***B65D 33/28*** | (2006.01) |
| ***A47G 29/20*** | (2006.01) |
| ***A47G 29/14*** | (2006.01) |

(52) U.S. Cl.

CPC ..... *B65D 33/00* (2013.01); *A47G 29/141* (2013.01); *A47G 29/20* (2013.01); *B65D 33/28* (2013.01); *A47G 2029/144* (2013.01); *A47G 2029/146* (2013.01)

(58) Field of Classification Search

CPC ..... B65D 33/34; B65D 33/26; B65D 31/04; B65D 33/2591; B65D 27/30; A45C 13/20; A45C 13/18; E05B 73/0005

USPC ..... 383/64, 5, 92; 70/68, 69; 190/101, 120

See application file for complete search history.

(56) References Cited

U.S. PATENT DOCUMENTS

| | | | | | |
|---|---|---|---|---|---|
| 651,256 | A | * | 6/1900 | May | 383/9 |
| 665,942 | A | * | 1/1901 | Tabler | 383/74 |
| 1,351,388 | A | * | 8/1920 | Kabaci | 383/25 |
| 2,631,338 | A | | 3/1953 | Peters et al. | |
| 2,635,304 | A | | 4/1953 | Peters | |
| 2,642,629 | A | | 6/1953 | Peters | |
| 4,066,195 | A | | 1/1978 | Dickler | |
| 4,175,604 | A | * | 11/1979 | Bonner | 383/5 |
| 4,694,668 | A | | 9/1987 | Ciletti et al. | |
| 4,783,978 | A | * | 11/1988 | Vallerga | 70/65 |
| 4,785,960 | A | * | 11/1988 | Belisle | 220/23.83 |
| 4,998,424 | A | | 3/1991 | Lambert, II | |
| 5,061,086 | A | * | 10/1991 | Vallerga | 383/16 |
| 5,347,833 | A | | 9/1994 | Branscum | |

(Continued)

FOREIGN PATENT DOCUMENTS

GB 2324100 * 10/1998

OTHER PUBLICATIONS

PCT International Search Report, dated Nov. 28, 2012.

*Primary Examiner* — Peter Helvey
(74) *Attorney, Agent, or Firm* — Gary Baker; Bio Patent

(57) ABSTRACT

A secure delivery apparatus, having: (a) a tamper-resistant pouch; (b) a closure mechanism disposed on the tamper-resistant pouch; (c) a locking cable that passes through the closure mechanism, thereby sealing shut the tamper-resistant pouch; and (d) a mounting bracket attachable to a fixed building structure such as a door or wall, wherein the locking cable connects the tamper-resistant pouch to the mounting bracket, thereby securing the tamper-resistant pouch to the fixed building structure.

24 Claims, 13 Drawing Sheets

(56) References Cited

U.S. PATENT DOCUMENTS

| | | | | |
|---|---|---|---|---|
| 5,595,073 | A * | 1/1997 | Sullivan | 70/18 |
| 5,624,071 | A | 4/1997 | Sosan | |
| 5,647,620 | A | 7/1997 | Kuenzel | |
| 5,890,919 | A * | 4/1999 | Geisler | 439/134 |
| 6,426,699 | B1 | 7/2002 | Porter | |
| 6,463,771 | B1 | 10/2002 | Judge | |
| 6,604,390 | B1 * | 8/2003 | Nooner | 70/63 |
| 6,744,980 | B2 * | 6/2004 | Cuddeback et al. | 396/25 |
| 7,106,202 | B2 | 9/2006 | Dickinson | |
| 7,185,871 | B2 * | 3/2007 | Orozco | 248/499 |
| 7,305,858 | B1 * | 12/2007 | Wu | 70/58 |
| D574,124 | S * | 7/2008 | Huber | D99/28 |
| 7,574,967 | B2 * | 8/2009 | Smith | 109/50 |
| 8,365,676 | B1 * | 2/2013 | McAuliff | 108/48 |
| 2002/0116289 | A1 | 8/2002 | Yang | |
| 2007/0250409 | A1 | 10/2007 | Levy | |
| 2009/0031610 | A1 | 2/2009 | Dudney | |
| 2010/0239190 | A1 * | 9/2010 | McNamara et al. | 383/5 |

* cited by examiner

SECURE UNATTENDED DELIVERY APPARATUS

RELATED APPLICATION

The present invention claims priority to U.S. Provisional Patent Application Ser. No. 61/626,530, filed Sep. 28, 2011, of same title, incorporated herein by reference in its entirety for all purposes.

TECHNICAL FIELD

The present invention relates to delivery and drop-off bags

SUMMARY OF THE INVENTION

The objective of the present invention is to provide a secure drop-off bag or pouch which can be left outside a building to receive deliveries. A first advantage of the present invention is that a person is not required to be home waiting for the delivery at the time the delivery is made. A second advantage of the present invention is that the drop-off bag or pouch is tamper-resistant, and can be firmly secured to a building door, wall, handrail, window grille or other fixed element. This gives the person receiving the delivery peace of mind since they know that the pouch can not be tampered with or opened in their absence.

Another objective of the invention is to provide a secure drop-off bag or pouch that can be opened and closed by both the person making, the deliveries and the person receiving the deliveries. As such, the same pouch can be used both to make drop-off and pick-up deliveries.

In one preferred embodiment, the present invention provides a secure delivery apparatus, comprising: (a) a tamper-resistant pouch; (b) a closure mechanism disposed on the tamper-resistant pouch; (c) a locking cable that passes through the closure mechanism, thereby sealing shut the tamper-resistant pouch; and (d) a mounting bracket attachable to a fixed building structure such as a door or wall, wherein the locking cable connects the tamper-resistant pouch to the mounting bracket, thereby securing the tamper-resistant pouch to the fixed building structure.

In various aspects, the mounting bracket may simply be attached to a wall. In other embodiments, it may be attached to a door or to a door handle. In one preferred embodiment, the mounting bracket is received around the side edge of a door such that it is secured in position when the door is closed.

The present invention has the advantage of using a single locking cable both to seal the tamper-resistant pouch shut and to secure the tamper-resistant pouch to the wall, door or other structure. Thus, only a single locking cable is needed, and therefore only one combination or key lock is required. As understood herein, a combination lock also covers locks that can be opened with a master key.

In preferred embodiments, the tamper-resistant pouch comprises an internal or external cable lattice, making the pouch very difficult to tear open or tamper with. As such, valuables can advantageously be safely left inside the pouch, even if the pouch is sitting outside a person's business or residence.

In preferred aspects, the closure mechanism comprises a plurality of reinforced grommet holes (or hard to cut rings attached to the bag) and a locking clasp in the upper flap. The locking clasp passes through the grommet holes, and then the locking cable is received through the locking clasp. This shuts the tamper-resistant pouch.

In optional embodiments, the mounting bracket has an RFID tag or printed indentifying indicia marked thereon. This enables the person making the delivery to scan or take a picture of the mounting bracket such that the correct delivery pouch can be delivered to the correct address, or the correct delivery can be can be left within the correct pouch. This facilitates package tracking in that scanning the mounting bracket itself can be used as a "signature" that the delivery has been made when no one is available to sign for the package.

Another important advantage of the present system is that deliveries can be made either: (a) by delivering a pouch with the valuables already therein and simply attaching that pouch to the mounting bracket; or (b) by opening the pouch (which is already attached to the mounting bracket), placing the valuables therein, and then re-sealing the pouch.

In another preferred aspect, the present invention provides a secure delivery apparatus, comprising: (a) a tamper-resistant pouch; (b) a closure mechanism disposed on the tamper-resistant pouch; (c) a locking cable that passes through the closure mechanism, thereby sealing shut the tamper-resistant pouch; and (d) a mounting support dimensioned such that an upper end of the tamper-resistant pouch hangs from the mounting support. It is to be understood that, in this context the mounting support can be a downwardly extending pole, mounting bracket attached to a building or any other form of support.

In this second embodiment, the tamper-resistant pouch can be wing-shaped, and is ideally suited for holding clothes on hangers hung therein. Advantageously, the same clasp that passes through the grommets (or hard to cut rings) to seal the tamper-resistant pouch can also be used to hang the clothes within the pouch itself. In this second embodiment, the mounting support may comprise an optional downwardly extending telescoping leg and an upwardly extending hook.

DETAILED DESCRIPTION OF THE DRAWINGS

FIGS. 1 to 3A, 4A to 5A and 6 show a first embodiment of the present invention.

Figure 3A:
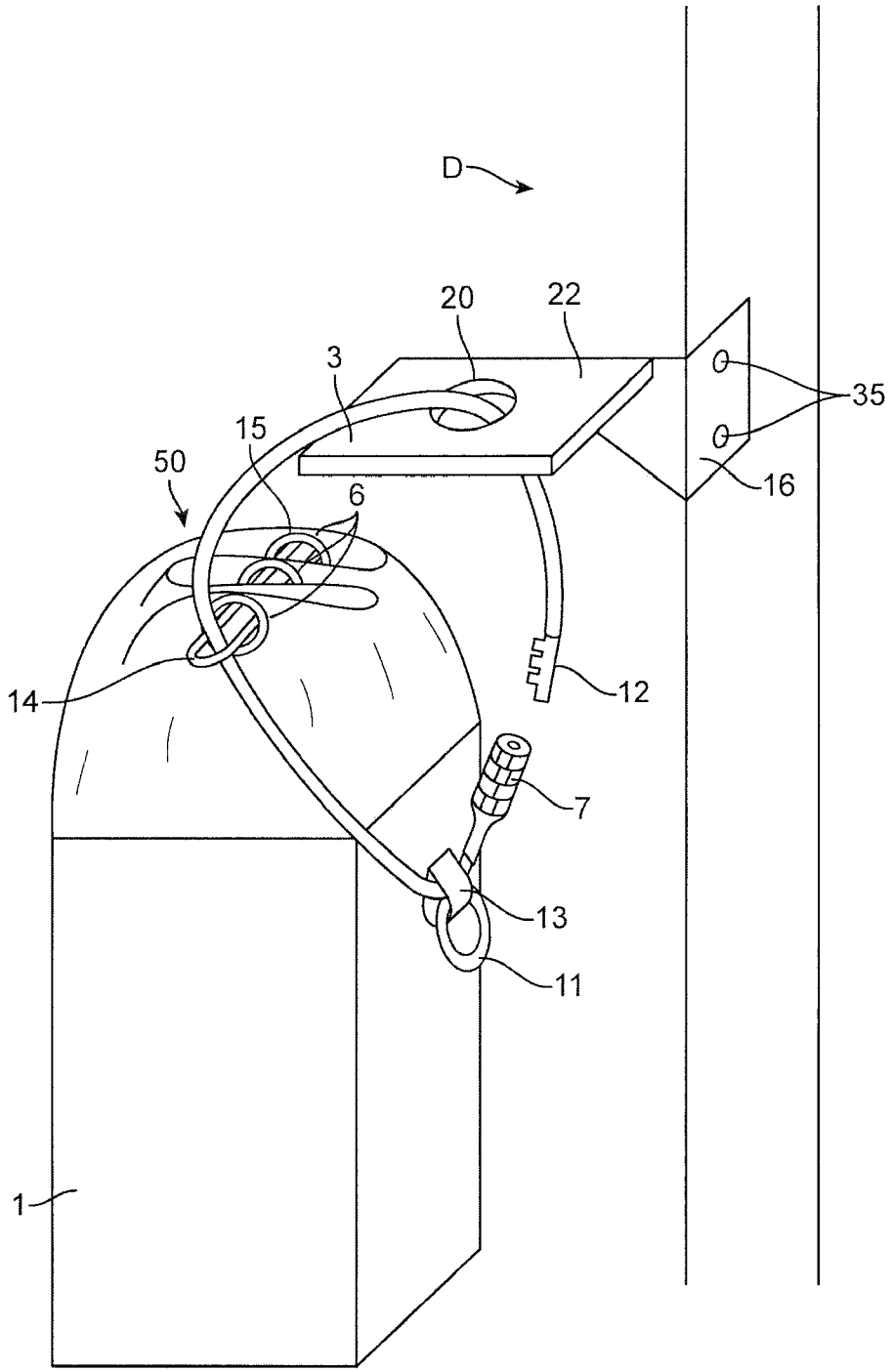
FIG. 3A is a close-up view corresponding to FIG. 1.
Figure 3B:
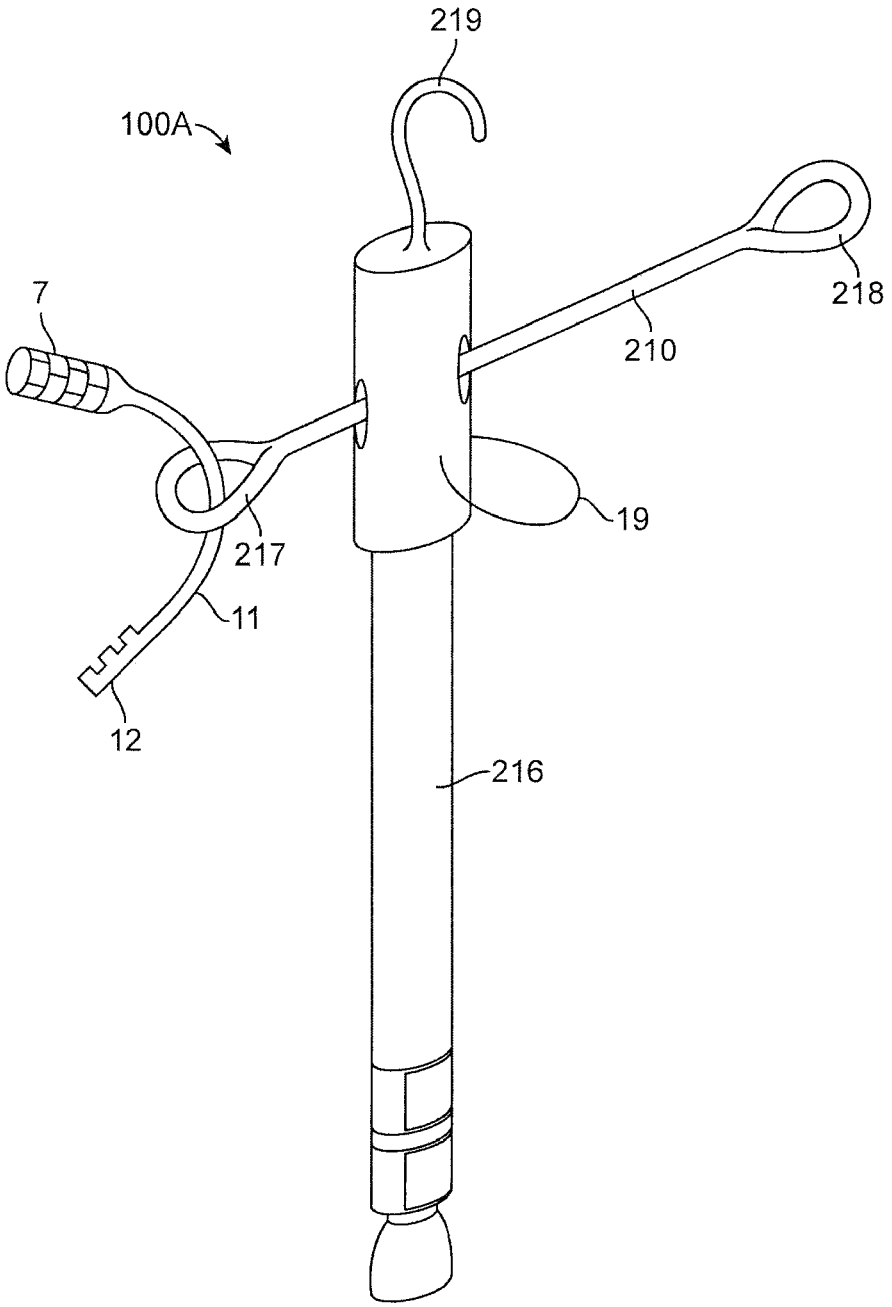
FIG. 3B is an illustration of a second embodiment of the present invention, showing the closure mechanism and locking cable (with the tamper-resistant pouch removed for clarity).
Figure 3C:
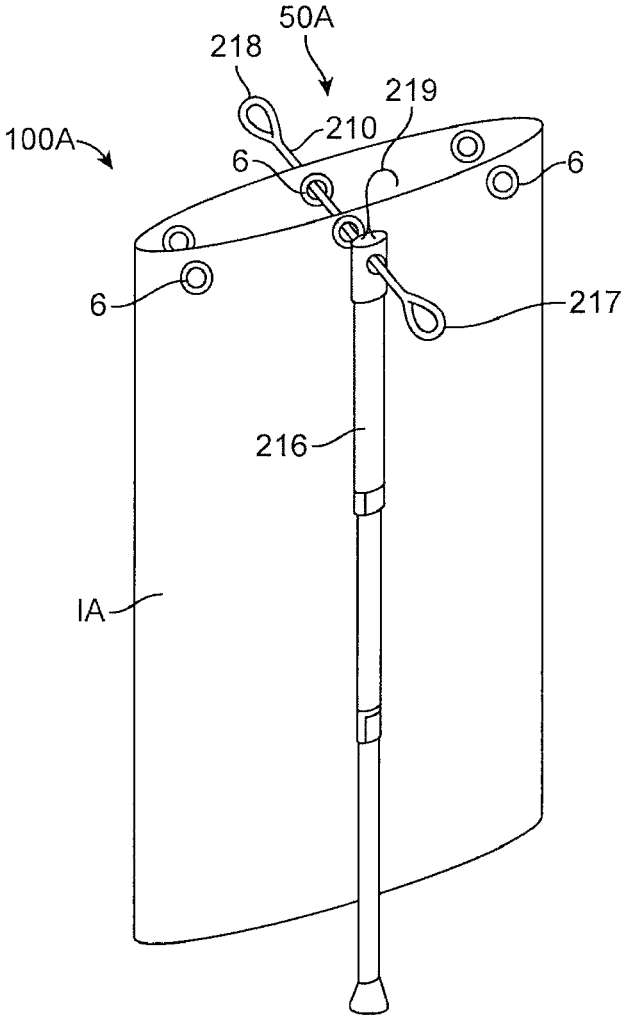
FIG. 3C corresponds to FIG. 3B, but shows the tamper-resistant pouch suspended from the closure mechanism (and the mounting support extended).

FIGS. 3B and 3C show a second embodiment of the invention.

Figure 5A:
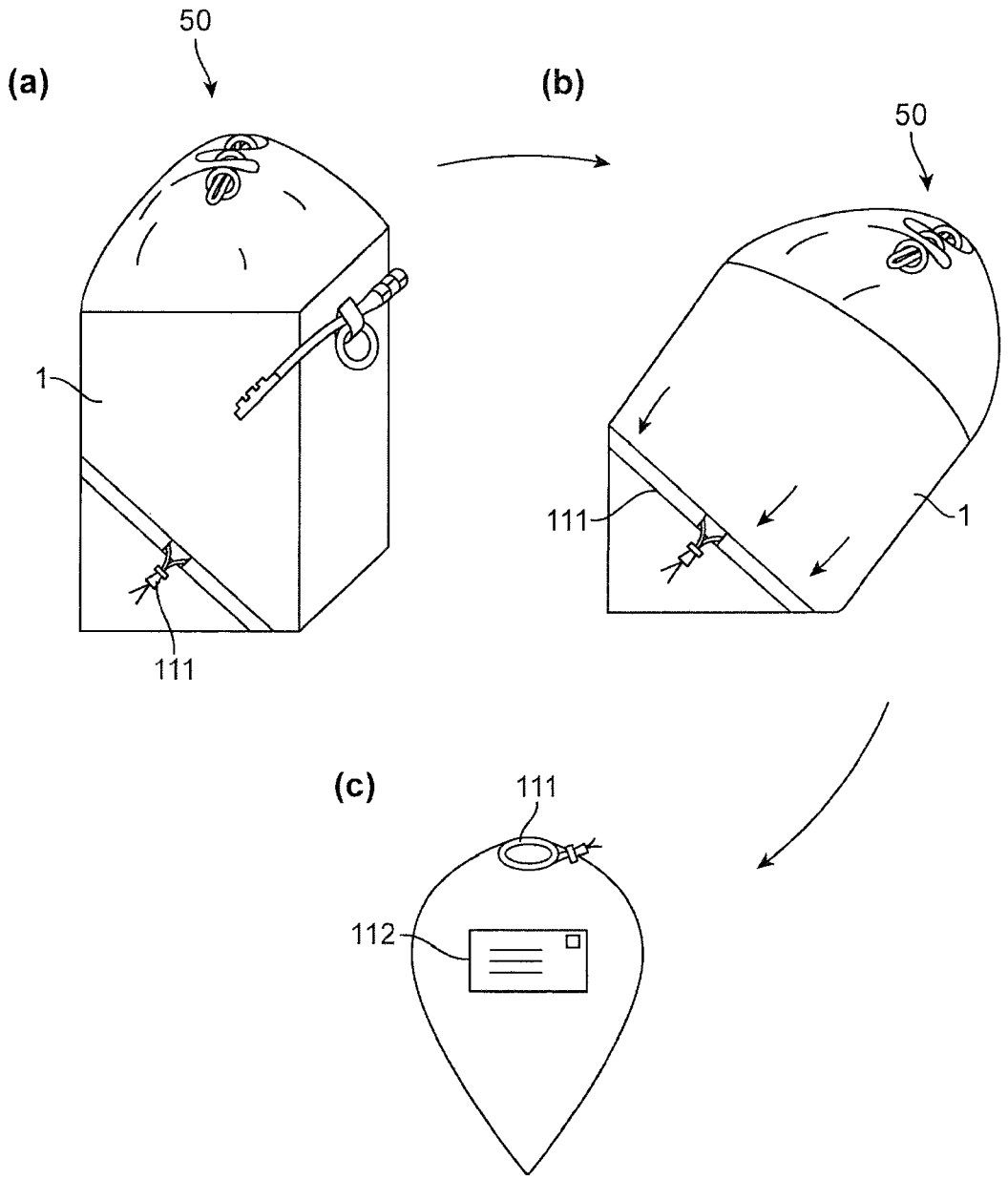
FIG. 5A shows a tamper-resistant pouch that can be collapsed in on itself for storage or when not in use.
Figure 5B:
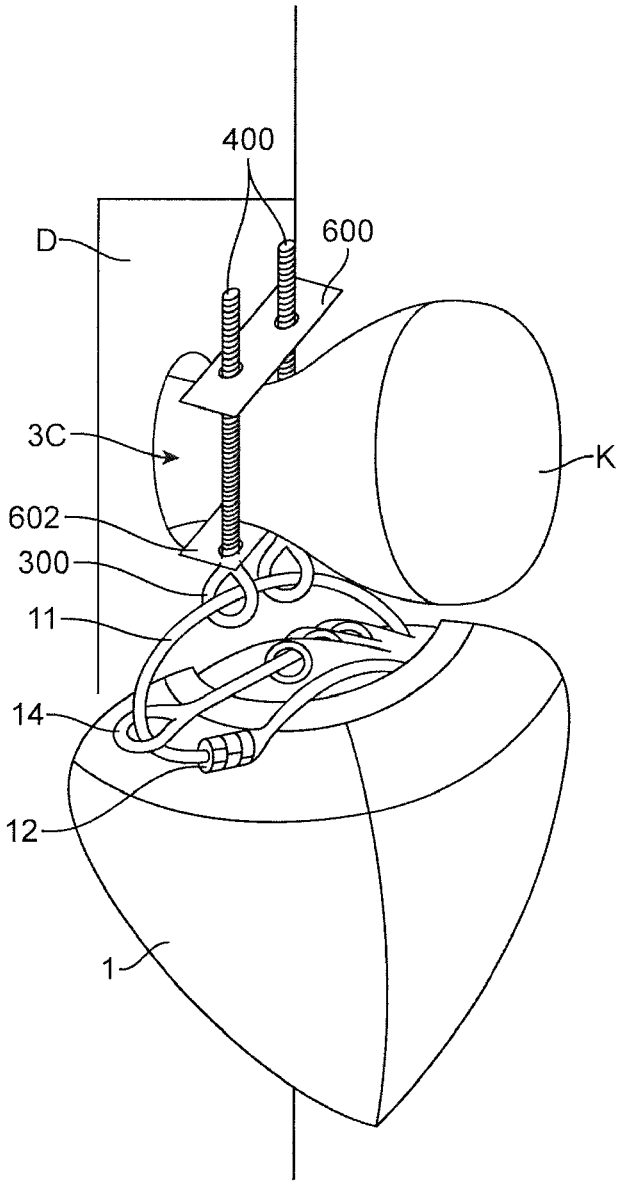
FIG. 5B shows an alternate mounting bracket received around a door knob.
Figure 6:
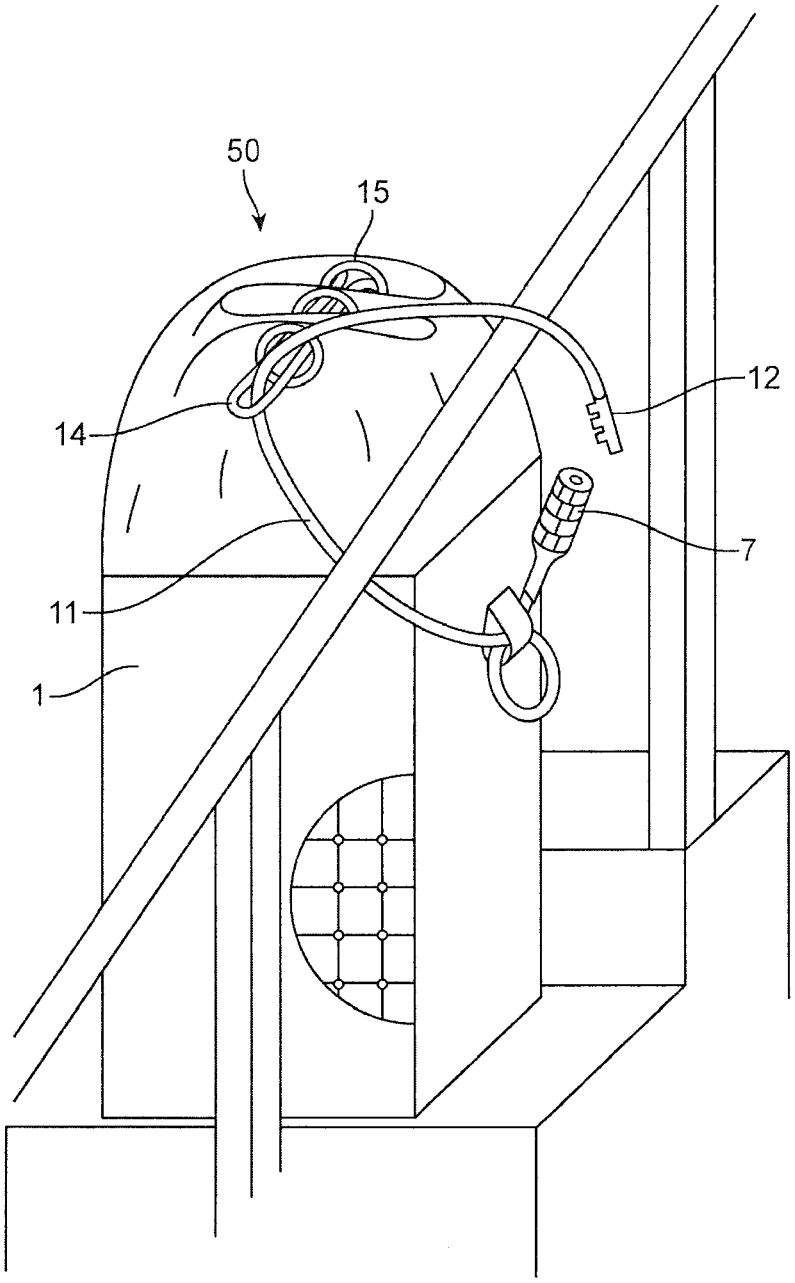
FIG. 6 shows the tamper-resistant pouch sitting on a building's steps, secured to a stair rail.

FIG. 5B shows a third embodiment of the invention.

Figure 1:
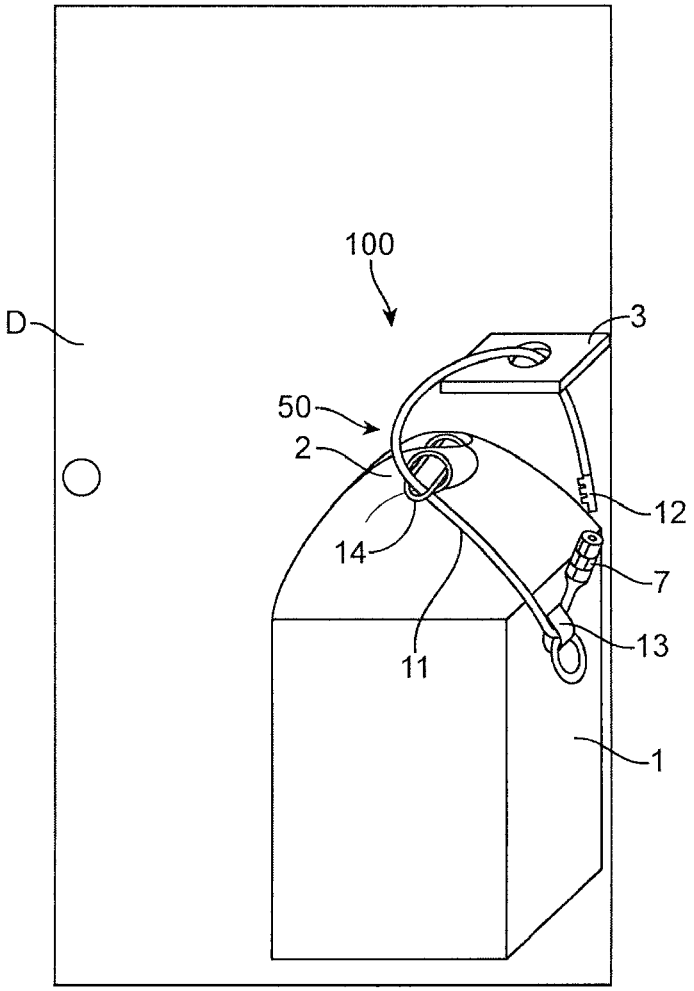
FIG. 1 is an illustration of the present tamper-resistant pouch sitting outside a door, and attached to the door by way of a mounting bracket.
Figure 2A:
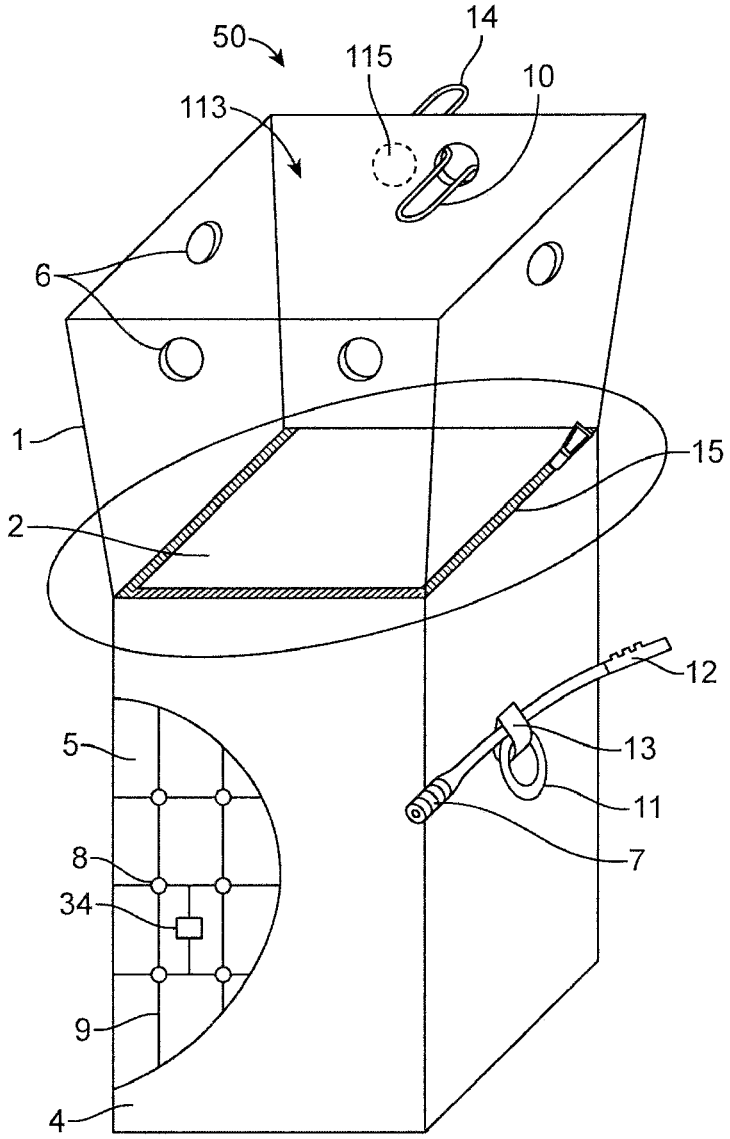
FIG. 2A is an illustration of the features of the tamper-resistant bag.
Figure 2B:
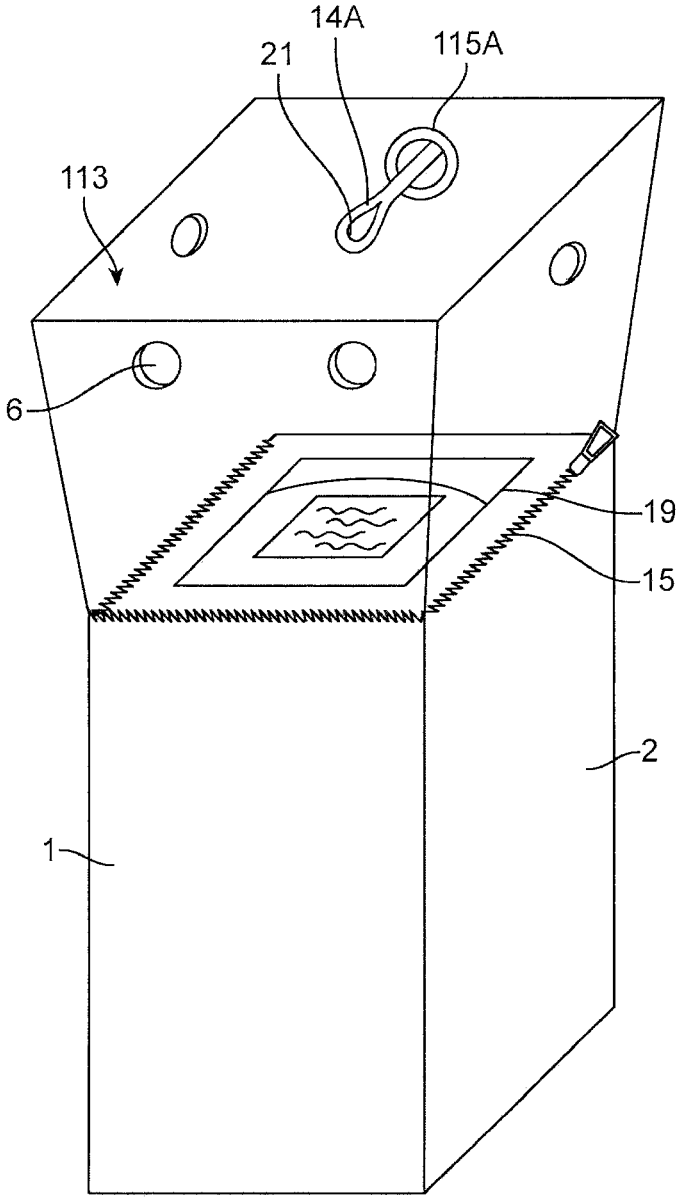
FIG. 2B is an illustration of another modification of the tamper-resistant bag.

Referring first to FIGS. 1 to 3A, a secure delivery apparatus 100 is provided. Apparatus 100 comprises: (a) a tamper-resistant pouch 1; (b) a closure mechanism 50 disposed at a top end of tamper-resistant pouch 1; (c) a locking cable 11 that passes through closure mechanism 50, thereby sealing shut the top end of tamper-resistant pouch 1; and (d) a mounting bracket 3 attachable to a fixed building structure such as a door or wall or handrail or window grille, or any other fixed element. The locking cable 11 is connected to mounting bracket 3 (as seen in FIGS. 1 and 3A), thereby connecting tamper-resistant pouch 1 to the fixed building structure, as shown. It is to be understood that the word "connected" as used herein refers to items being connected, attached, affixed, etc., in any format without limitation.

Tamper-resistant pouch 1 may be made from a flexible and generally water-resistant material, including but not limited to metal, plastic or any other material that is hard to cut or puncture. Optionally, the material selected may also be flame resistant such that it cannot easily be melted with matches or a lighter. Such material is highly resistant to cutting, tearing or puncturing, and is easily collapsible into a compact form. In addition, tamper-resistant pouch 1 can also be made of (or otherwise incorporate) insulation materials designed to keep its inner contents hot or cold.

As can be seen, an important convenience and advantage of the present invention is that a single locking cable 11 both locks closure mechanism 50 (thereby sealing closed tamper-resistant pouch 1 shut) and also secures the tamper-resistant pouch 1 to the mounting bracket 3. This has the advantage of having one lock perform both functions.

As seen in FIG. 2A, tamper-resistant pouch 1 may comprise a cable lattice 9 made of any strong, lightweight, flexible material chain, wire cable or any other high-strength material. Cable lattice 9 may be round like a traditional cable, or flat like tape. The present invention is understood to encompass all forms of cables, or comparable securing mechanisms. Preferably, cable lattice 9 is an open net-type structure made of metal cables, thereby making it very difficult to cut into or tear open tamper-resistant pouch 1. Cable lattice 9 may optionally be positioned between an outer panel 4 and an inner panel 5. Alternatively, cable lattice 9 may be positioned fully inside or outside of pouch 1. It is to be understood that the present cable lattice 9 covers all embodiments of lattice or net-type cable structures, regardless of their method of construction. In further optional embodiments, an alarm 34 can be attached to cable lattice 9 with lattice 9 completing an electrical circuit such that the alarm is triggered if the lattice 9 is cut through.

Inner and outer panels 4 and 5 can be made of a suitable cut, tear and puncture-resistant material. Inner panel 5 may optionally be formed from multiple layers of flexible materials interlocked together. Carrying handles and straps can be attached to outer panel 4 for ease of handling and storage. In addition, optional backpack straps or temporary or permanent wheels can be added to large tamper-resistant pouches as desired.

Optionally as well, locking chain 11 passes through a carrying strap 13 on the side of the tamper-resistant pouch. This conveniently holds locking chain 11, for example when it is not in use. Alternatively, locking chain 11 can remain passing through carrying strap 13 when tamper-resistant pouch 1 is secured to mounting bracket 3 (as shown in FIG. 1). This configuration has the added benefit of securing locking cable 11 to tamper-resistant pouch 1 at two locations (i.e.: both through closure mechanism 50 and through carrying strap 13). In optional embodiments, a stopper can be attached to locking cable 11 such that the locking cable cannot be separated from pouch 1. It is to be understood that such a stopper may comprise any suitable mechanism for affixing or connecting locking cable 11 to tamper-resistant pouch 1.

FIG. 2A shows a sealed lower portion 2, closed by zipper 15. FIG. 2B shows an optional pouch 19 into which documents can be placed. Pouch 19 sits on top of sealed lower portion 2. Optionally, pouch 19 may be incorporated into the zippered flap, and a return delivery envelope or mailing bag may be placed into pouch 19. This enables a customer to return the entire pouch via mail service.

As seen in FIGS. 1 and 2A, pouch 1 preferably has an upper flap portion 113 and its closure mechanism 50 preferably comprises a plurality of holes that may be reinforced with grommets 6 and a first locking clasp 14. (Note: grommets 6 can be any form of grommet, hard to cut metal rings or other suitable fabric reinforcing system or material). To close pouch 1, locking clasp 14 is first inserted through the various grommet holes 6. Next, locking cable 11 is received through locking clasp 14, thereby locking shut the tamper-resistant pouch. Locking clasp 14 is preferably made of a cut-resistant metallic material. Locking clasp 14 has a base 15 at which it is connected to upper flap portion 113 of tamper-resistant pouch 1.

As seen in FIG. 2B, a locking clasp 14A can be a long element over which the grommets 6 are received. (Locking clasp 14A has a base 115A). Next, after locking clasp 14A is inserted through grommets 6, locking cable 11 is fed through hole 21 at the end of locking clasp 14A, thereby sealing the top end of pouch 1. Base 115A prevents locking clasp 14 from simply passing through grommets 6, thereby securing pouch 1 shut after locking cable 11 has passed through locking clasp 14A.

Optionally, as seen in FIG. 2A, a second locking clasp 10 can be included. Second locking clasp 10 permits tamper-resistant pouch 1 to be locked to a fixed building structure while the tamper-resistant pouch is open. For example, locking clasp 10 may be used together with a padlock (not shown) to lock pouch 1 directly to mounting bracket 3 while locking clasp 14 is not in use (and the pouch is open). Optional locking clasp 10 may also be used to padlock one pouch to another. It is to be understood that locking clasps 10 and 14 are interchangeable as illustrated herein since either one can be used to lock pouch 1 shut while the other one is used to lock the pouch directly to a fixed structure.

A further advantage of the present invention is that locking cable 11 can also be used to secure more than one pouch 1 together. For example, the same locking cable 11 can be used to secure two pouches 1 to the same mounting bracket 3. This can be done by simply passing the same locking cable 11 through each of the locking clasps 14 or 14A that are sealing shut the separate tamper-resistant pouches 1.

As seen in FIG. 3A, mounting bracket 3 has an aperture 20 through which locking cable 11 passes. In one preferred embodiment, locking cable 11 has a combination lock 7 at one end and a corresponding lock receiver 12 on the other end. It is to be understood that a locking "cable" as used herein means a chain or any other cable, made out of any suitable material. It is also to be understood that non-combination locks (such as key or electronic locks) may be substituted for combination lock 7, all keeping within the scope of the present invention.

Mounting bracket 3 is attachable to a door. Optionally, mounting bracket 3 has a front portion 22 dimensioned to extend along the front of the door D and a side portion 16 dimensioned to extend along the side of door D. Locking cable 11 is connected to the front portion 22 of mounting bracket 3, as shown. This attaches the tamper-resistant pouch 1 to the door D. In various embodiments, mounting bracket 3 may be made of one or more pieces of metal or other strong material such as hard plastic, fiberglass or composite material. The present invention is thus not limited to any particular design of mounting bracket. Note: front portion 22 may be angled so as not to interfere with door operation or present a sharp edge to the building occupant.

Figure 4A:
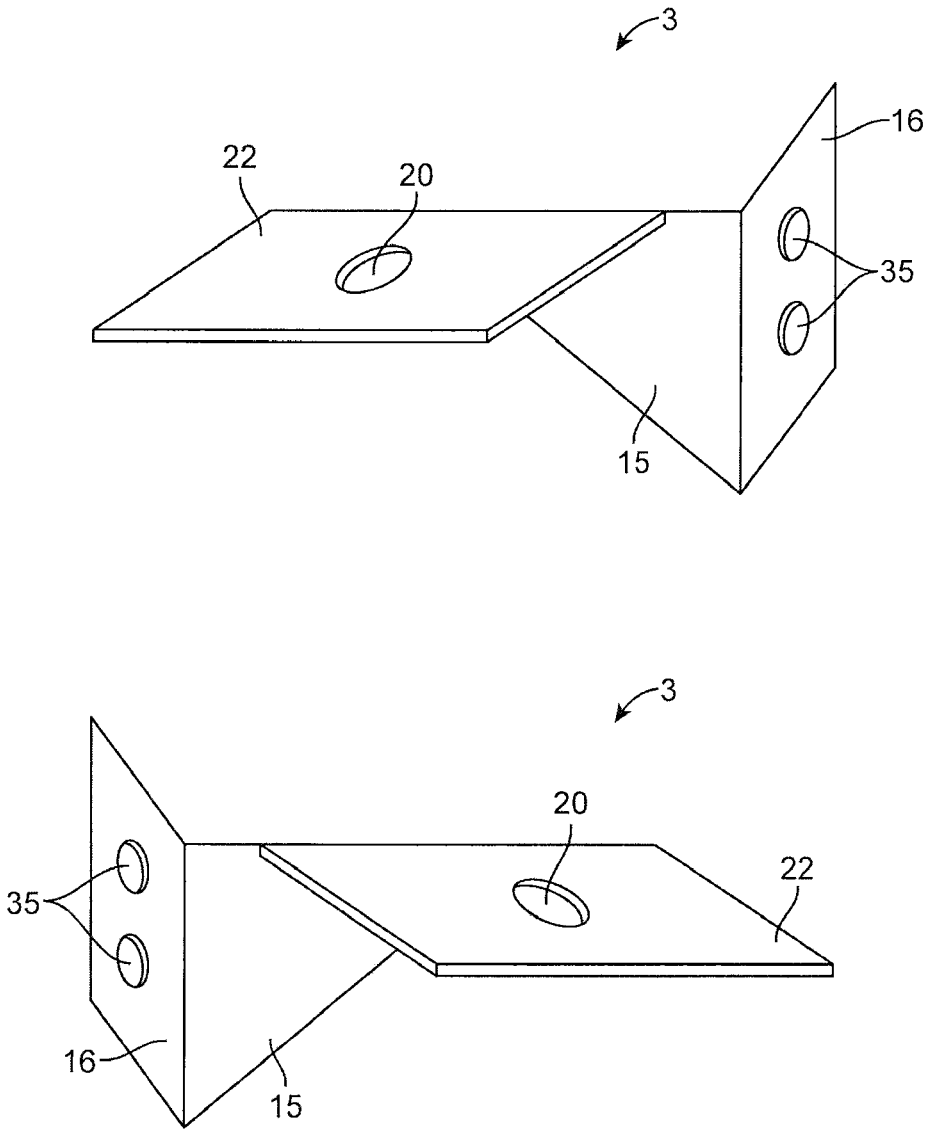
FIG. 4A shows perspective views of left and right versions of the door mounting bracket of the first embodiment of the invention.

FIG. 4A shows left and right door opening versions of mounting bracket 3. Both have a front portion 22 with an aperture 20 passing therethrough. Front portion 22 is connected to portion 15 which also runs along the front of the door. A side portion 16 extends back from portion 15. Side portion 16 has apertures 35 through which screws or nails can be passed, thereby securing side portion 16 flush against the side of an open door. In optional embodiments, portion 16 can be ⅛ inch thick, so that portion 16 will not interfere with the opening or closing of the door. It is to be understood, however, that this dimension is merely exemplary and that the present invention is not limited to any particular sizes, and can be used with any type of house or building doors or even widows that open. Preferably, the holes drilled into the side of door D can be countersunk such that the heads of screws passing through holes 35 will be flush with the face of portion 16. This would also prevent portion 16 from interfering with the opening and closing operation of the door or window. Other methods of connecting portion 16 to the side of a door (such as gluing, taping or Velcro™) are also contemplated within the scope of the present invention. In addition, portions 15 and 16 may be coated with soft, scratch-resistant material so as to protect against scratches to the door.

Figure 4B:
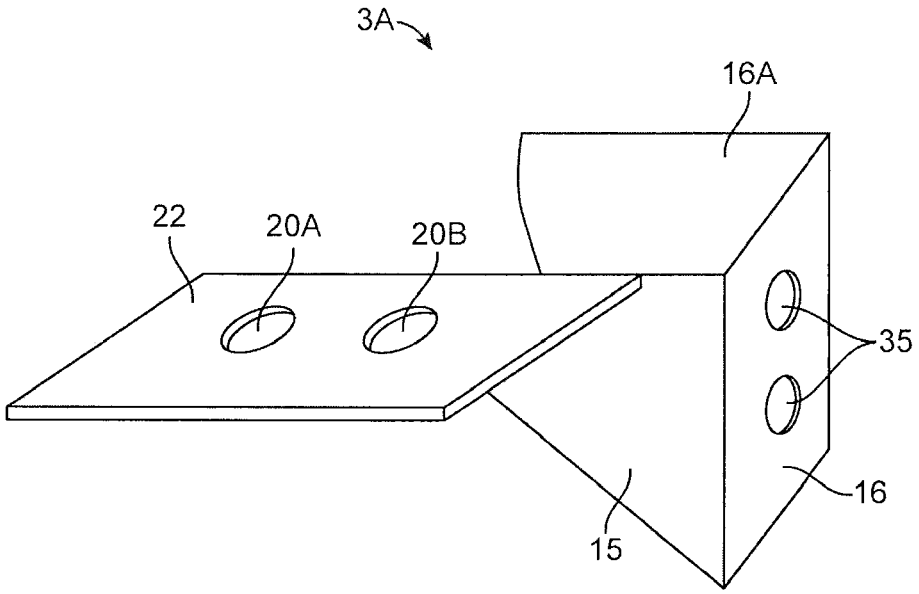
FIG. 4B shows a perspective view of another embodiment of the door mounting bracket of the first embodiment of the invention.

FIG. 4B illustrates another version of mounting bracket 3A. In this version, there are two holes 20A and 20B in front portion 15. These two holes can be used to lock pouch 1 to mounting bracket 3, with one hole being for locking cable 11 and the other being for a padlock, combination lock or another locking cable. In this arrangement, the hole with the padlock prevents pouch 1 from being taken away from the door. Alternatively, these two holes can be used to attached separate locking cables 11, each with their own pouches 1 (not shown) so that two pouches can be delivered and attached to the same mounting bracket. This offers yet another advantage of the present invention in that one pouch can be used for pick up and the other can be used for drop off of deliveries. Or, different pouches can be used to make different deliveries by different delivery companies. It is therefore to be understood that the present invention encompasses any embodiment where one or more pouches are used in conjunction with the same mounting bracket.

FIG. 4B also illustrates an additional back portion 16A attached to side portion 16. Back portion 16A is received around behind the back side of the door. As a result, mounting bracket 3A is firmly held in position when the door is closed. In this particular embodiment of the mounting bracket, holes 35 and screws passing therethrough may not even be necessary (since bracket 3A will be held in position whenever door D is closed). Back portion 16A is designed such that it rests against the portion of the hinge that extends from the door itself. This allows the weight placed upon element 22 to rest against the portion of the hinge extending from the door. As a result, the weight of filled pouch 1 does not damage the door.

Figure 4C:
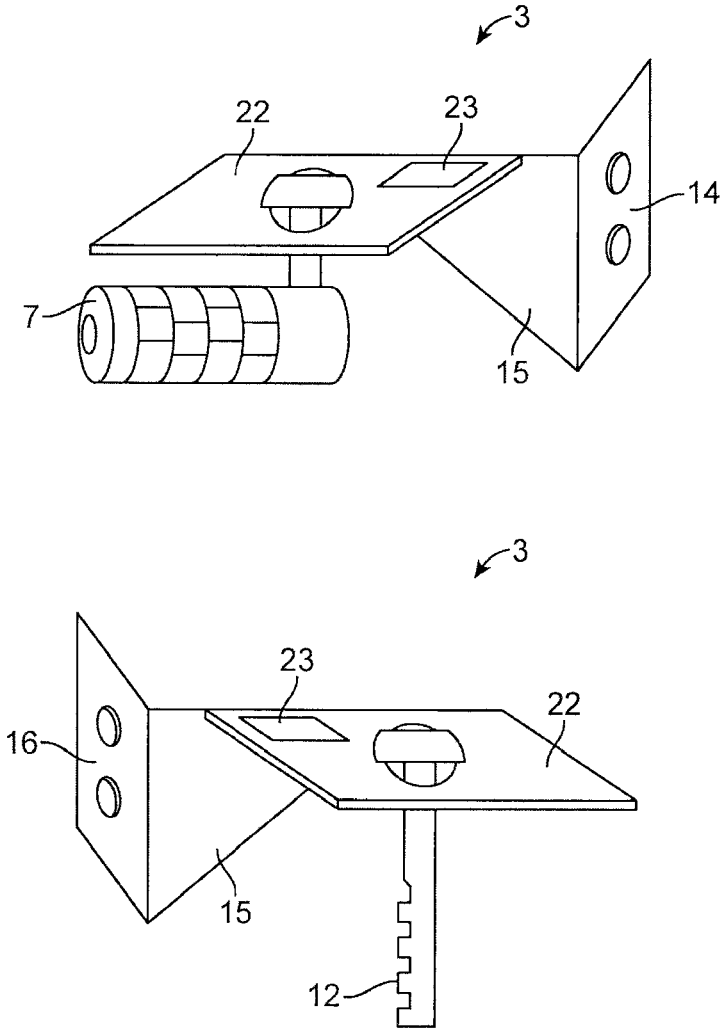
FIG. 4C shows two additional mechanisms for attaching a locking cable to the door mounting bracket.

FIG. 4C shows an alternate preferred embodiment in which one of the two devices found at the ends of locking cable 11 (i.e.: combination lock 7 or lock receiver 12) are instead mounted directly to (or pass through) mounting bracket 3. In this embodiment, locking cable 11 will either have a corresponding lock receiver 12 or combination lock 7 at one end and an opposite end that is large enough such that it doesn't simply slip through clasp 14 or 14A (not shown).

In addition, mounting bracket 3 may have an RFID tag or printed indentifying indicia 23 attached thereto, or marked thereon. The advantage of having such tags or indicia on the mounting bracket is that the person or company making the delivery or pickup would simply need to scan the tag to verify that the correct delivery was being made at the correct location. Similarly, corresponding RFID tags or printed indentifying indicia could be incorporated into each of tamper-resistant pouches 1 as well. Such tags can be scanned to act as delivery "signatures" when no one is home to provide a physical signature. In operation, the person receiving the deliveries simply needs their own personal mounting bracket installed and then optionally register it with the company or person making the deliveries.

Figure 4D:
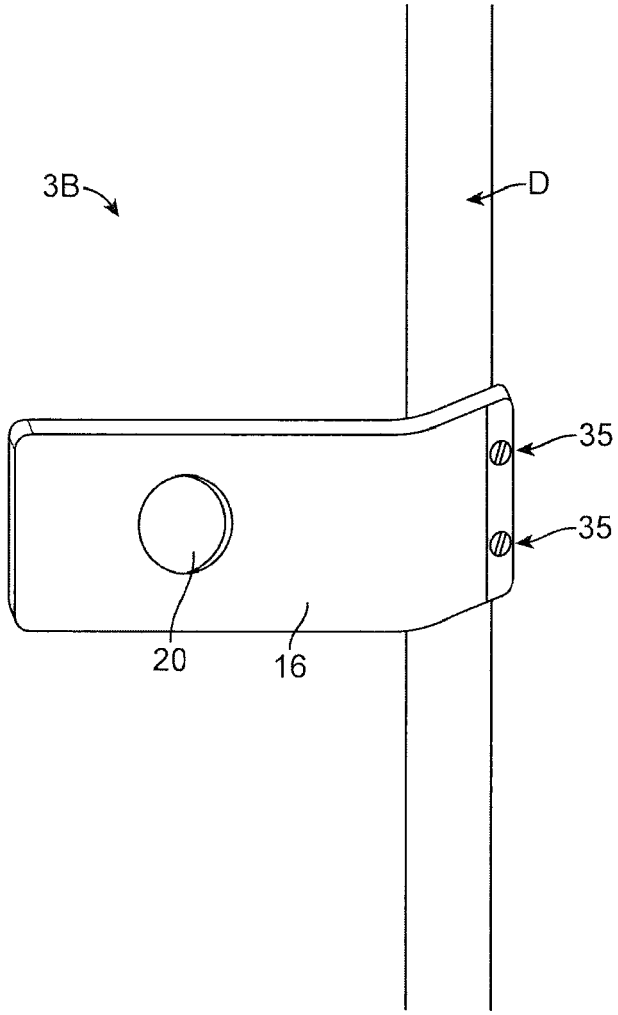
FIG. 4D shows yet another embodiment of the door mounting bracket.

FIG. 4D shows a simplified strap-type mounting bracket 3B having only a single portion 16 connected onto the side of door D, and extending forward from the door. Portion 16 may be generally curved to wrap close to the front of the door, so that it does not present a pointed front edge that could injure someone opening or closing the door. Mounting bracket 3B is made of a thin, flexible yet hard to cut material. It's thinness ensures that it can be inserted between the door and door frame without interfering with their operation. Screws passing through holes 35 prevent strap-type mounting bracket 3B from being removed by sliding out between the door and the door frame. Note: Instead of screws passing through holes 35, buttons can be placed at the same location to ensure that bracket 3B does not slip.

FIG. 5A shows a tamper-resistant pouch that can be collapsed in on itself for storage or when not in use. Specifically, pouch 1 has a cinch loop 111. In operation, the entire pouch 1 can be collapsed into a compact form by stuffing the entire bag into one corner of the bag and then closing cinch loop 111 to keep the pouch in a compact form. Return delivery instructions 112 may be printed right onto pouch 1, as shown. The advantage of this is that return delivery can be performed after the contents of pouch 1 have been retrieved by the intended recipient, or their agent. An optional mailing pouch can be included in pouch 1 for mailing pouch 1 back to its sender after the delivery has been received.

FIG. 5B shows an alternate mounting bracket 3C received around a door knob K. In this embodiment, mounting bracket 3C comprises a frame made of two long screws 400 having loops 300 at their ends and two bars 600 and 602 also having holes passing therethrough. As can be seen, screws 400 are received through the holes in bars 600 and 602.

Upper bar 600 has threads into which the screws are received, whereas lower bar 602 does not have threaded screw holes. As a result, tightening screws 400 will cause bars 602 and 600 to move closer together, thereby locking bracket 3C in position behind door knob K. Locking cable 11 then passes through loops 300 in screws 400 such that the locking cable prevents the rotation (i.e.: unscrewing) of the screws, thereby keeping mounting bracket 3C secure around the door handle. As can be seen, the horizontal distance between screws 400 is fixed by bars 600 and 602. It is to be understood, therefore, that different widths of bars (i.e.: different horizontal spacings between the holes) can be used depending upon the dimensions of the door knob. The correct dimensions (i.e.: length) minimizes the horizontal distance between the two screws, thereby providing additional security.

FIGS. 3B and 3C illustrate a second embodiment of the invention. Specifically, a secure delivery apparatus 100A is provided. Apparatus 100A comprises: (a) a tamper-resistant pouch 1A; (b) a closure mechanism 50A disposed at a top end of tamper-resistant pouch 1A; (c) a locking cable 11 that passes through closure mechanism 50A, thereby sealing shut the top end of the tamper-resistant pouch; and (d) a mounting support 216 dimensioned such that an upper end of tamper-resistant pouch 1 hangs from mounting support 216, as shown.

Similar to the first embodiment, locking cable 11 comprises a combination lock 7 at one end and a lock receiver 12 at the other end. (Note: cable 11 has been shortened in length in FIG. 3B for clarity of illustration).

Similar to the first embodiment described above, tamper-resistant pouch 1A has an upper portion with the closure mechanism 50A comprising a plurality of reinforced grommet holes 6 and a locking clasp passing therethrough. In this embodiment, the locking clasp 210 has an aperture 218 at its distal end. Locking clasp 210 passes through grommet holes 6. Thereafter, locking cable 11 is received through aperture 218 in locking clasp 210, thereby locking shut the tamper-resistant pouch 1A.

As can be seen in FIG. 3C, pouch 1A can be wing-shaped (i.e.: having a wide front and a wide back with very narrow sides). Such a dimension for pouch 1A is specifically useful when apparatus 100A is used to drop off or pick up clothes. Specifically, clothes hangers can easily be placed within pouch 1A and be hung from locking clasp 210 such that clothes can be hung on hangers within pouch 1A. Locking cable 11 can then be used both to lock shut closure mechanism 50 (thereby sealing closed tamper-resistant pouch 1A), and also to lock tamper-resistant pouch 1A to mounting bracket or other structure (not shown). In addition, locking clasp 210 may also have an aperture 217 through which locking cable 11 can be held.

Mounting support 216 is preferably constructed from a strong but light weight material (such as plastic or aluminum). As can also be seen by comparing FIGS. 3B and 3C, the mounting support 216 may optionally include a downwardly extending telescoping leg. (Note: FIG. 3B shows the leg retracted and FIG. 3C shows the leg extended). In operation, the clothes in pouch 1A can be kept from wrinkling by being held in a standing position by extended mounting support 216. In addition, an optional upwardly extending hook 219 can also be included. In operation, hook 219 can be used to store apparatus 100 when not in use or as a handle when carrying the device 100A.

In its various embodiments described above, deliveries and pickups of various items can be easily handled (either using the embodiment of the invention seen in FIG. 3A, or that seen in FIGS. 3B and 3C), as follows.

First, the intended delivery recipient attaches a mounting bracket 3 onto their door. The person making the delivery then attaches the pouch 1 to the mounting bracket 3 by locking cable 11. After the delivery has been made, the recipient can be notified (by any means) that the delivery is ready for pickup. The recipient then unlocks locking cable 11, and opens pouch 1. As was stated above, an advantage of the present invention is that deliveries can be made either by locking a new pouch 1 onto mounting bracket 3, or by opening an existing pouch (that has already been locked to the mounting bracket) and simply inserting new delivery contents into the pouch. The same process works in reverse when the customer requests outward delivery of items. In the case of such outward delivery, the customer notifies the company that the items are within the pouch and are ready for pick up. Return delivery can be made either by emptying the contents of the pouch or by taking the pouch with the contents therein. In fact, different delivery services may operate differently with some services: (a) taking the pouch or delivering a new pouch with the contents therein; or (b) simply opening and closing the pouch so as to remove or insert the contents therein.

What is claimed is:

1. A secure delivery apparatus, comprising:

(a) a tamper-resistant pouch comprising a flexible outer surface;

(b) a closure mechanism disposed on the tamper-resistant pouch and comprising a locking clasp and a plurality of holes through the flexible surface, wherein the locking clasp is mounted to the pouch and adapted to run through the holes to seal the pouch;

(c) a locking cable that passes through the closure mechanism locking clasp, thereby locking sealing shut the tamper-resistant pouch; and (d) a mounting bracket attachable to a fixed building structure, wherein the locking cable is adapted to connect the tamper-resistant pouch to the mounting bracket, while the cable is also locking the closure mechanism, thereby securing the tamper-resistant pouch to the fixed building structure.

2. The secure delivery apparatus of claim 1, wherein the mounting bracket has an aperture through which the locking cable passes.

3. The secure delivery apparatus of claim 1, wherein the mounting bracket is attachable to a door and has a front portion dimensioned to extend along the front of the door and a side portion dimensioned to extend along the side of the door, and wherein the locking cable can be connected to the front portion of the mounting bracket, thereby attaching the tamper-resistant pouch to the door.

4. The secure delivery apparatus of claim 1, wherein the locking cable comprises a combination or electronic lock at one end and a lock receiver at the other, wherein the receiver is adapted to be received into the lock when locked.

5. The secure delivery apparatus of claim 1, wherein the tamper-resistant pouch comprises a cable lattice.

6. The secure delivery apparatus of claim 1, wherein the tamper-resistant pouch has an upper flap portion and the closure mechanism comprises the plurality of holes and a first locking clasp in the upper flap, and wherein the first locking clasp is adapted to pass through the holes, and wherein the locking cable is adapted to be received through the first locking clasp after the first locking clasp has been passed through the holes, thereby locking shut the tamper-resistant pouch.

7. The secure delivery apparatus of claim 1, wherein the tamper-resistant pouch comprises a separately sealed lower inner portion.

8. The secure delivery apparatus of claim 1, wherein the tamper-resistant pouch further comprises a second locking clasp, permitting the tamper-resistant pouch to be locked to the fixed building structure while the tamper-resistant pouch is open.

9. The secure delivery apparatus of claim 1, wherein the locking cable both locks the closure mechanism to seal closed the tamper-resistant pouch and also locks the tamper-resistant pouch to the mounting bracket.

10. The secure delivery apparatus of claim 1, wherein the mounting bracket has an RFID tag thereon.

11. The secure delivery apparatus of claim 1, wherein the mounting bracket has identifying indicia marked thereon.

12. The secure delivery apparatus of claim 1, wherein the mounting bracket has a lock receiver mounted thereto for connection to the locking cable.

13. The secure delivery apparatus of claim 1, wherein the mounting bracket is attachable around a door handle and comprises a frame through which the locking cable passes such that the locking cable secures the frame to the door handle.

14. A secure delivery apparatus, comprising:

(a) a tamper-resistant pouch comprising a flexible upper portion;

(b) a closure mechanism mounted to the upper portion and comprising a plurality of grommet holes and a first locking clasp in the upper portion;

(c) a locking cable adapted to pass through the closure mechanism grommets or clasp, thereby sealing shut the tamper-resistant pouch; and (d) a mounting support dimensioned such that an upper end of the tamper resistant pouch can hang from the mounting support in use.

15. The secure delivery apparatus of claim 14, wherein the locking cable comprises a combination lock or electronic lock at one end and a corresponding lock receiver at the other end of the cable, wherein the receiver is adapted to be received into the lock when locked.

16. The secure delivery apparatus of claim 14, and wherein the first locking clasp passes through the grommet holes, and wherein the locking cable is received through the first locking clasp after the first locking clasp has been passed through the grommet holes, thereby locking shut the tamper-resistant pouch.

17. The secure delivery apparatus of claim 14, wherein the locking cable both locks the closure mechanism to seal closed the tamper-resistant pouch and also locks the tamper-resistant pouch to the mounting bracket.

18. The secure delivery apparatus of claim 14, wherein the tamper-resistant pouch is wing shaped.

19. The secure delivery apparatus of claim 14, wherein the mounting support comprises a downwardly extending telescoping leg.

20. The secure delivery apparatus of claim 14, wherein the mounting support comprises an upwardly extending hook.

21. A secure delivery apparatus, comprising:

(a) a tamper-resistant pouch;

(b) a closure mechanism mounted to an upper portion of the pouch and comprising a locking clasp and a plurality of grommet holes in the upper portion, wherein the upper pouch portion is flexible and adapted to be shut by gathering the flexible upper portion to align the grommet holes of the flexible portion allowing the locking clasp to be inserted through the aligned grommets;

(c) a locking cable adapted to run through the locking clasp thereby locking shut the tamper-resistant pouch; and (d) a mounting bracket attachable to a fixed building structure, wherein the locking cable connects the tamper-resistant pouch to the mounting bracket, thereby securing the tamper-resistant pouch to the fixed building structure.

22. The secure delivery apparatus of claim 21, wherein the mounting bracket has an aperture through which the locking cable is adapted to pass.

23. The secure delivery apparatus of claim 21, wherein the mounting bracket is attachable to a door and has a front portion dimensioned to extend along the front of the door and a side portion dimensioned to extend along the side of the door, and wherein the locking cable can be connected to the front portion of the mounting bracket, thereby attaching the tamper-resistant pouch to the door.

24. The apparatus of claim 1, wherein the closure mechanism comprises two or more of the holes in the flexible fabric surface through which the locking clasp is adapted to run.

* * * * *